US006739882B2

(12) United States Patent
Fuehrer et al.

(10) Patent No.: US 6,739,882 B2
(45) Date of Patent: May 25, 2004

(54) CONNECTOR

(75) Inventors: Thomas Christian Fuehrer, Heilbronn (DE); Michael Grimm, Mosbach (DE); Joerg Zenkner, Pfedelbach (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 09/795,498

(22) Filed: Mar. 1, 2001

(65) Prior Publication Data

US 2001/0019922 A1 Sep. 6, 2001

(30) Foreign Application Priority Data

Mar. 1, 2000 (DE) ..... 100 09 749
Mar. 1, 2000 (DE) ..... 100 09 750

(51) Int. Cl.[7] ..... H01R 4/66
(52) U.S. Cl. ..... 439/95; 439/347; 439/752
(58) Field of Search ..... 437/20, 701, 607, 437/744, 752, 696, 95, 939, 188, 92, 347, 851, 723, 787, 788, 101, 108, 109

(56) References Cited

U.S. PATENT DOCUMENTS 3,582,865 A * 6/1971 Franck et al. ..... 361/702
3,674,961 A * 7/1972 Wright, Jr. ..... 200/295
4,483,575 A * 11/1984 Kruger et al. ..... 439/102
5,073,120 A * 12/1991 Lincoln et al. ..... 439/215
5,122,080 A * 6/1992 Hatagishi et al. ..... 439/595
5,571,033 A * 11/1996 Kinsey et al. ..... 439/595
5,716,233 A * 2/1998 Muzslay ..... 439/595
5,975,955 A * 11/1999 Bogiel et al. ..... 439/607
6,004,163 A * 12/1999 Behling et al. ..... 439/362

FOREIGN PATENT DOCUMENTS

EP 0 268 890 6/1988
EP 0 610 681 8/1994

* cited by examiner

*Primary Examiner*—P. Austin Bradley
*Assistant Examiner*—James R. Harvey
(74) *Attorney, Agent, or Firm*—Blank Rome LLP

(57) ABSTRACT

A connector part comprises an elongate metal housing defining an interior chamber and having a first or rearward open end and spaced therefrom a second or forward open end, an elongate insulating body adapted to be inserted into said elongate metal housing from said first end by moving said insulating body towards said second end, wherein said insulating body comprises an elongate contact body and an elongate slide member, said contact body (contact insert) and said slide member being adapted to be mounted together said contact body having formed on a first side first elongate contact chambers. First and second elongate contact elements are adapted to be inserted into said first contact chambers, said slide member being provided with contact chambers for said first contact elements so as to fixedly mount said first contact elements in said elongate contact chambers provided by the contact body and the elongate contact chambers provided by said slide member.

9 Claims, 3 Drawing Sheets

CONNECTOR

BACKGROUND OF THE INVENTION

The invention relates to an electric connector, in particular to a rectangular connector. The invention also relates to a connector part and an insulating body thereof carrying contact elements of a connector. The invention further relates to mounting means for contact elements of a connector.

A known mounting means for contact elements of a connector comprises, as is shown in EP 0 610681 A2, an insulating body consisting of two parts, a so-called body and a lateral mounting portion. The lateral mounting portion is provided with a plurality of resilient teeth which can snappingly engage with respective seat means in the body. The contact elements are inserted into the respective seats of a radially outer group from the outer circumferantial side relative to the body. The contact elements in the seats of the radially inner group are inserted by moving the contact elements in radial direction. When inserting the contact elements, they move through slots until they reach an opening through which the contact elements are individually placed into the respective seats. So as to allow this maneuver the opening defines a free space having dimensions which are larger than the maximum diameter of each of said contact elements.

Further, attention is drawn to EP 0 268 890.

SUMMARY OF THE INVENTION

The present invention relates to a connector part, a connector, in particular a rectangular connector, and mounting means for contact elements in the connector part, in particular of the rectangular connector. The invention also relates to mounting means for at least one so-called PE contact element or grounding contact element In accordance with the invention, the mounting of the contact elements in an insulating body (also called contact insert) of a connector can be easily carried out, at the same time providing that the contact elements are securely mounted or supported in contact chambers formed by said insulating body. The mounting of the contact element(s) is provided such that the mounting of the insulating body, preferably with the contact elements having been inserted, can be carried out from the reverse or backside of a housing. No additional mounting means, e.g. screws, are required for the insulating body.

The simplified mounting is also available for the mounting of at least one PE contact element, thus providing a safe contact between the PE contact elements and the housing. The insulating body can be inserted, after the contact elements including the PE contact element have been inserted into the insulating body, from the rear into a metal housing.

A connector part of a connector comprises an elongated metal housing defining an interior chamber and having a first or rearward open end and spaced therefrom a second or forward open end. The connector part further comprises an elongated insulating body adapted to be inserted into said housing in a direction from said first or rearward open end towards said spaced second or forward open end. Abutment means are provided so as to locate the elongate insulated body in a certain desired position within said elongate metal housing. The insulating body comprises an elongate contact body and an elongate slide member adapted to be fixedly mounted together. Said contact body has opposite first and second sides. On said first side elongate contact chambers are provided and on said second side at least one elongate contact chamber is provided first and second elongate contact elements are adapted to be inserted into said first and second contact chambers. The slide member as well as the contact body have generally the form of a parallelepiped. The slide member comprises at one of its larger side surfaces contact chambers, which are adapted to cooperate with the contact chambers for the first contact elements of said contact body, thus to securely support the contact elements in the insulating body formed by said contact body and said slide member. For the at least one second contact element, which preferably is a PE contact element, support means additional to the contact chamber in the contact body are provided by the elongate metal housing preferably by a rib. Also, contact means are provided on said metal housing to provide an electric connection with said second contact element preferably in the form of a PE contact element.

Figure 1:
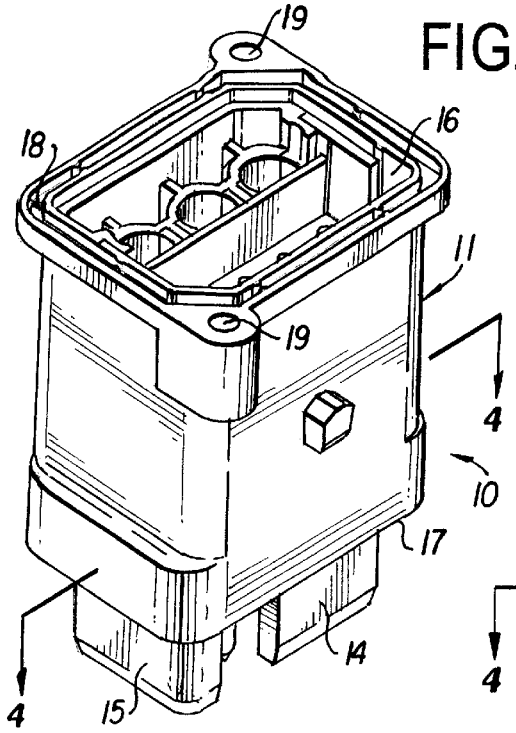
FIG. 1 is a perspective view of a connector part from above of a connector shown in FIG. 10.
Figure 2:
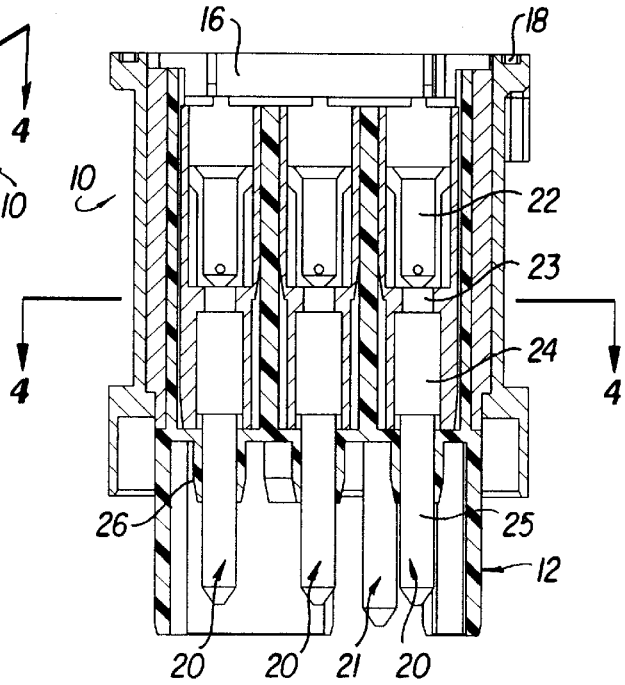
FIG. 2 is a cross-sectional view of the connector part of FIG. 1.
Figure 3:
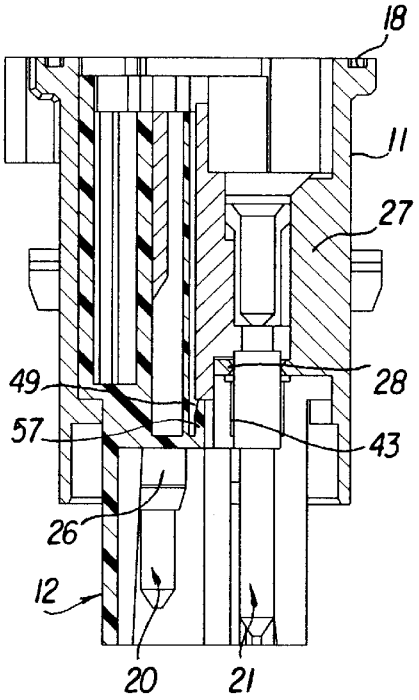
FIG. 3 is a cross-sectional view of the connector part of FIG. 1 along line 3—3 of FIG. 2.
Figure 4:
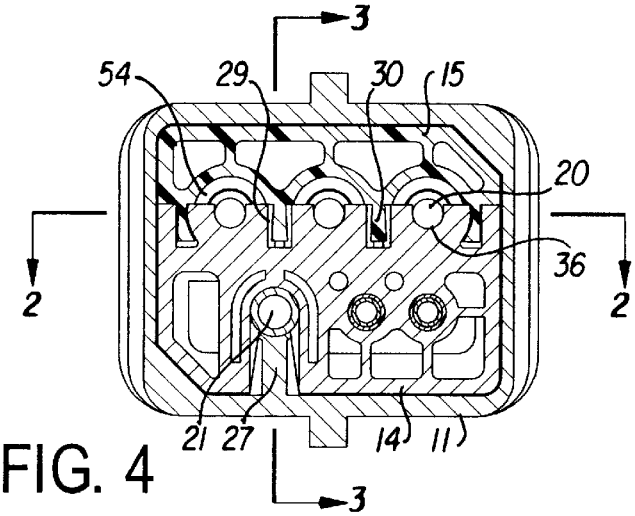
FIG. 4 is a cross-sectional view of the connector part of FIG. 1 along line 4—4 of FIG. 1 or FIG. 2.
Figure 5:
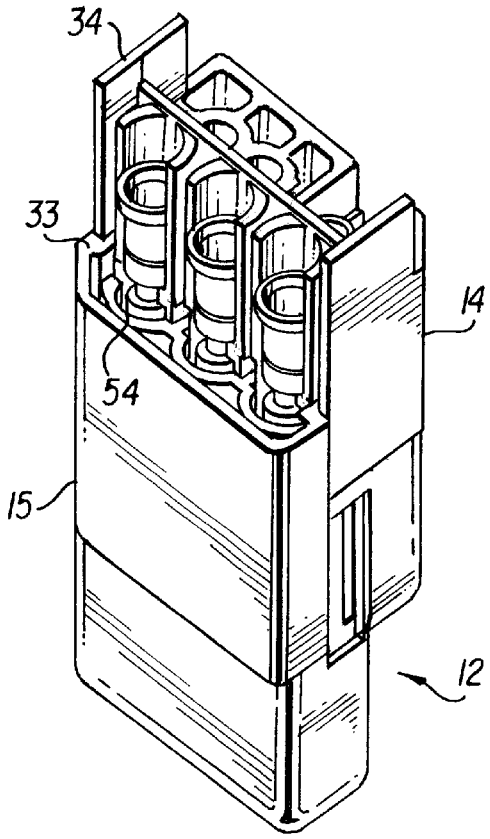
FIG. 5 is a perspective view of the insulating body of the connector part of FIG. in an inclined direction from above.
Figure 6:
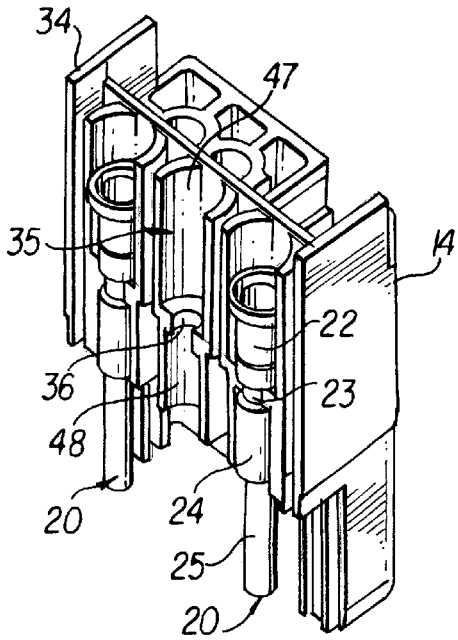
FIG. 6 is a perspective view of the contact body of the insulating body of FIG. 5 in an inclined direction from above.
Figure 7:
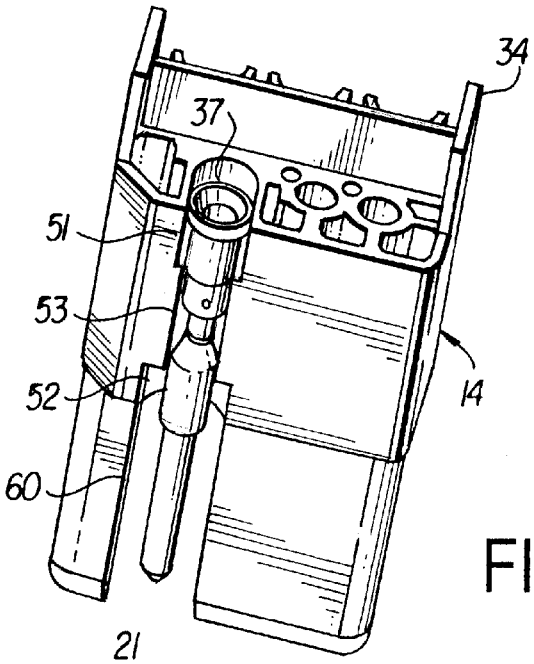
FIG. 7 is a perspective view of the backside of the contact body of FIG. 6 in an inclined direction from above.
Figure 8:
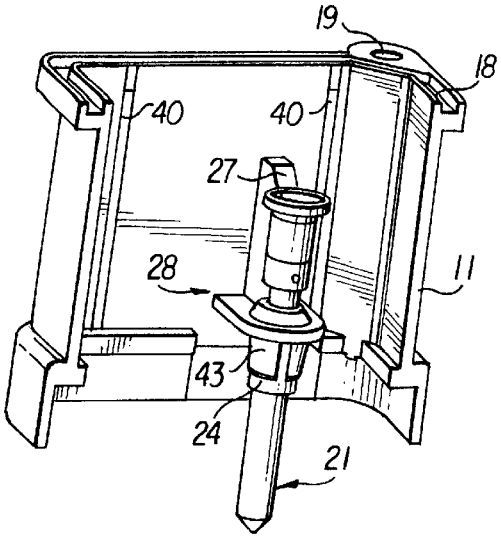
FIG. 8 is perspective view of a housing of the connector part carrying a PE contact element and a spring element according to a first embodiment of the invention.
Figure 9:
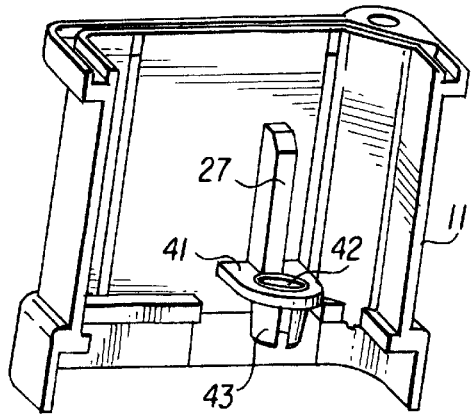
FIG. 9 is a view similar to FIG. 8 of the housing with a PE contact element.
Figure 10:
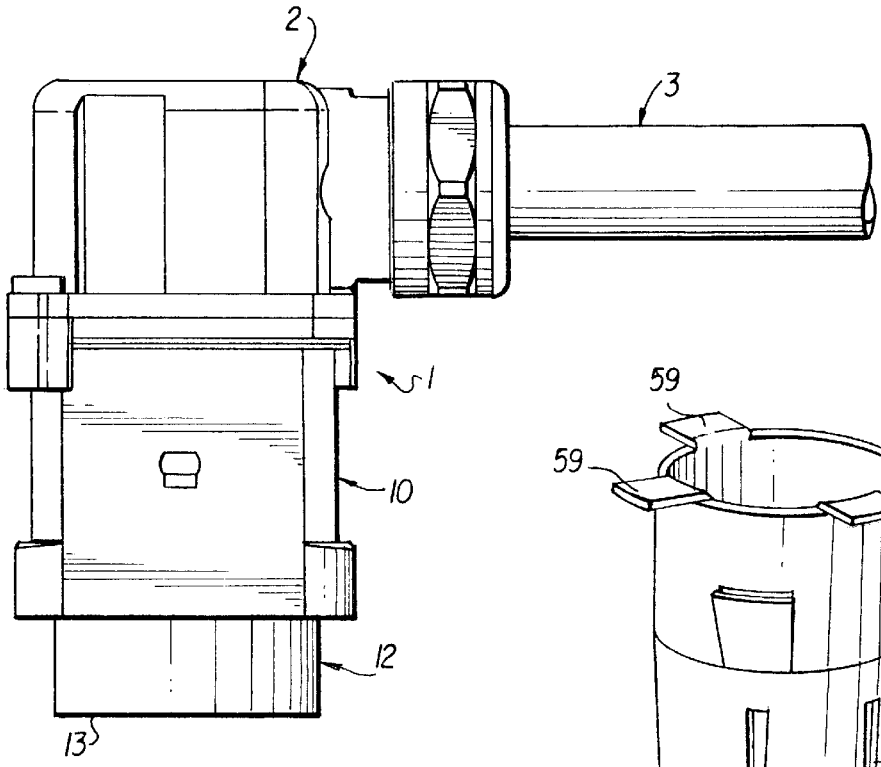
FIG. 10 is a side elevational view of the connector of the present invention comprising the connector part of FIG. 1.

Prior to a description of the individual FIGS. 1 to 11 it should be noted that FIG. 10 shows a connector 1 which provides for an electrical connection between a cable 3 and contact elements located within that connector 1; said contact elements are referred to by reference numerals 20 and 21 and can be seen for instance in FIG. 2. Indeed, what is shown in FIGS. 1 to 4, and the details thereof as shown in FIGS. 5 through 7, relates to a connector part 10 (FIG. 10) of the connector 1. The upper part or cover 2 of connector 1, i.e. the part above part 10 is not shown in the other figures.

As shown in FIGS. 1 to 4 the connector part 10 comprises a housing 11 which is preferably a single piece metal member having a substantially rectangular shape in cross section. The housing 11 could also be a metalized plastic member. The housing 11 has the form of a parallelepiped and is hollow having an upper or rearward opening 16 and a lower or forward opening 17. An upper surface which surrounds the upper opening 16 is provided with a peripheral groove 18 adapted to receive a sealing ring made of a resilient material. At two opposite corners of the upper surface of the housing 11 two threaded bores 19 are provided in reinforcements of housing walls. By screwing threaded bolts (not shown) into said threaded bores 18 the connector part 10 can be mounted to the cover 2 of the connector 1 as shown in FIG. 10. In this manner, contact elements 20, 21 which are mounted to individual cable conductors are located in that housing 11.

As shown in FIG. 8, the inner side or surface of housing 11 is provided with guide ribs 40 which allow an easier mounting and a linear guidance when moving or inserting an insulating body (also called contact insert) 12 into the housing 11. Preferably, the guide ribs 40 increase slightly towards the inside. By means of the guide ribs 40 the insulation body 12 can be easily mounted in the housing 11 with little force being required and with high precision. Moreover, the insulating body 12 sits, after being mounted in that housing, therein with little play.

In the embodiment shown the contact elements 20, 21 are pin or male contact elements and will also be referred to as male contacts or pin contacts. It is possible to use instead of the male contacts female contacts.

As far as the contact elements 20, 21 are concerned, there are first contact pins 20 and second contact pins 21. Preferably, there is just one second contact pin 21, which is a PE-contact pin 21. As can be seen in FIG. 2 both the first contact pins 20 as well as the second or PE-contact comprise the following: a first abutment or bearing section 22, a detent or snap-in section 23, a second abutment bearing section 24 and a contact section 25. The diameters of the first and second abutment sections 22, 24 of the contact pins 20, 21 are the same but larger than the diameter of the contact section 25 and of the detent section 23. Further, the diameter of the detent section 23 is smaller than the diameter of the contact section 25.

As can be seen in FIGS. 1 and 2 the insulating body (also called contact insert) 12 can be mounted in the housing 11 from above or, expressed differently, the insulating body 12 is inserted—seen in the direction of insertion—from the rear to the front until it abuts at the inner peripheral projection of the housing 11 as seen in FIGS. 2, 3, and 8 and 9.

As can be readily seen in FIGS. 1 to 7 the insulating body 12 comprises two parts: an elongate contact body 14 and an elongate contact element cover in the form of a slide member (slider) 15. The elongate insulating body 12 is adapted to receive the elongate contact pins 20, 21 in a manner yet to be described and is (as mentioned) inserted into the housing 11 through the rearward or upper opening 16 before the cover 2 is fixed to the housing 11 by means of screws. After insertion of the insulating body 12 into the housing 11 a lower or forward end 13 (see FIG. 10) will project together with the ends of the pin contacts 20, 21 out of the housing 11 through the lower opening 17. The insulating body 12 fills the interior of the housing 1 t completely and is substantially flush with the upper surface of the housing 11. FIG. 2 shows the insulating body 12 inserted into the housing 11 supporting a row of first contact pins 20 and also a PE-contact pin 21.

As shown in FIGS. 2 to 7 the elongate contact body 14 is preferably a single piece of plastic in the form of a parallelepiped having a generally rectangular cross section. The contact body 14 comprises two oppositely located larger rectangular surfaces, called a first or upper and a second or lower surface. At its upper surface open contact chambers 35 extend in longitudinal direction of the contact body 14 (See FIG. 6). Said open contact chambers 35 are adapted to receive the first contact pins 20. As is shown in FIG. 6, the contact chambers 35 can be divided into the following sections: a first contact chamber section 47, a semi-circular narrow section 36, and a second contact chamber section 48. The opening of the semi-circular narrowed section 36 is, in addition, slightly smaller than the diameter of the detent section 23 of the contact pins 20, 21, so as to resiliently hold an inserted contact element or pin 20.

As shown particular in FIG. 4 slots 29 are provided between the open contact chambers 35. The slots 29 extend parallel to the contact chambers 35. The slots 29 have, at least partially, a trapezoidal profile and taper inwardly. Below the front end of the contact chambers 35 (see FIG. 3) a groove 49 is provided in the contact body 14. The groove 49 extends transversely with respect to the longitudinal direction of the contact body 14. At the reverse or back side (see FIGS. 5 and 6 (but note that the reference numeral 37 is inserted only in FIG. 7) there is located a PE contact-chamber 37 adapted to receive the PE-contact pin 21. The PE-contact chamber 37 comprises as is shown in FIG. 7 a first PE-contact chamber section 51, a PE-contact chamber reduction 53 and a second PE-contact chamber section 52.

The slider 15 shown in FIGS. 2 to 5 is also preferably made of a plastic material as a single piece in the form of a parallelepiped of generally rectangular cross section. The slider 15 has at its (in FIG. 4) lower side contact recesses 54 which have a first contact recess section and a second contact recess section (not shown). The contact recesses 54 are separated by ribs 30 which extend parallel to the contact recesses 54 and have a trapezoidal profile and are adapted to cooperate with the slots 29. The thickness of the ribs 30 increases towards their free ends.

Moreover, at the forward ends of the recesses 54 guide members 26 (FIG. 2) are provided, each of which is combined with a recess 54. Also at the forward ends of the recesses 54 a tongue 57 is provided which extends transversely with respect to the longitudinal direction and which is in engagement with the groove 49 when the contact body 14 and the slider 15 are slid into engagement with each other. A contact body 14 and a member corresponding to the slider 15 but not designed to be brought into engagement with the contact body 14 by sliding action, but by a different movement towards each other and locking contact body and said member together could also be used.

The isometric views of the contact body 14 shown in FIGS. 6 and 7 disclose the detent or snap-in mechanism of the contact pins 20, 21 in the contact body 14. The first contact pins 20 can be inserted into the open contact chambers 35, by slightly pressing the detent section 23 of the first contact pins 20 into the circular narrowed section 36 of the open contact chamber 35. Due to the resiliency of the material of the contact body the first contact pins 20 are held by a detent or snap-in action. In this detent or snap-in position of the first contact elements 20 their first and second support sections 22, 24, respectively, are placed and held in the respective first and second contact chamber sections 47, 48.

As shown in FIG. 7, the PE-contact pin 21 is similarly snapped into the PE-contact chamber 37 as is done for the first contact pins 20. For this purpose, the PE-contact pin 21 is inserted sideways through the longitudinal slot 60 with the consequence that the first and second support sections 22, 24, respectively, of the PE-contact pin 21 are being placed in respective first and second PE-contact chamber sections 51, 52. Also, the detent section 23 will be placed in the reduction or narrowed section of the PE-contact chamber section 53 The second PE-contact chamber section 52 is, however, larger than the second support section 24 of the PE-contact pin 21, so that a free space is created, which will later be filled by a spring element 43 (FIG. 9) yet to be described.

The isometric view of FIG. 5 shows the insulating body 12 and in particular the slider 15, which is being mounted on the contact body 14 comprising locked detent contact pins 20. For mounting purposes, the slider 15 is placed on the contact body 14 such that the ribs 30 of the slider 15 are aligned with the slots 29 on the contact body 14. By the relative movement between the slider 15 and the contact body 14 with the ribs 30 being placed in the slots 29 and the sliding movement continues up to an end position where the upper edge 33 of the slider aligns with the upper edge 34 of the contact body 14. Thus both parts, the slider 15 and the contact body 14, are fixed to each other in the end position preferably by inserting the tongue 57 into the groove 49. Thus the form sliding action of the contact body 14 and the slider 15 into each other fittingly mounts and secures the first contact pins 20 and (half-ways) in the open contact chambers 35 of the contact body 14 and (half-way) in the contact recesses 54 of the slider 15. Moreover, due to relative movement between the contact body 14 and the slider 15, the guide members 26 of the slider 15 are moved onto the contact sections 25 of the first contact pins 20 50 as to provide additional support.

The PE-contact pin 21 is located in the insulating body 20 by a snap-in action in a plane or side different and opposite from the plane or side of the first contact pins 20 as can be seen in FIG. 4. As is shown in FIG. 4, the PE-contact pin 21 is inserted into the PE-contact chamber 37 in the contact body 14, whereby only the first support section 22 of the PE-contact pin 21 is received. However, the PE-contact pin 21 is held or supported in the PE contact chamber by support means provided at the housing 11. E.g. additional support is provided by a rib 27 located at the inner wall of the housing 11. Moreover, a spring element 43 encloses a portion of the second support section 24 of the PE-contact pin 21. The spring element 43 is fixedly mounted at the lower edge of the rib 27 in a flange 28 in a circular opening. Moreover, it can be recognized, how the rib 27 of the housing 11 guides the PE-contact pin 21 in its movement when inserting the insulating body 12 into the housing 11 and thus guarantees that the PE-contact pin 21 is aligned with the flange opening 42 and the spring element 43.

As shown in FIGS. 8 and 9 the rib 27 extends on an inner wall of the housing 11 and extends into the interior of the housing 11. At the lower end of the rib the flange 28 extends perpendicularly with respect to the side wall and the rib 27. The flange 28 has a surface which is parallel to the upper opening 16 of the housing 11 and perpendicular to the extension of the rib 27. In the upper surface 41 of the flange the circular flange opening 42 is provided. Into that flange opening 42 the cylinder-shaped spring element 43 of the invention is inserted. In accordance with a first embodiment of the present invention, the spring element 43 comprises a peripheral groove which will be placed on the bottom side of the flange 28. Moreover, the spring element 43 is crimped at the upper end of the flange 28 whereby the spring element 43 is mounted to the flange 28. Alternatively, the spring element 43 could be formed at the flange.

When inserting the insulating body 12 into the housing 11 the rib 27 projects through the PE-contact chambers 37 into the insulating body 12 and guides the PE-contact pin 21 during its movement. For the further movement of the insulating body 12 the PE-contact pin 21 initially enters with its contact portion 25 the flange opening 42 and the spring element 43. When the insulating body 12 is completely inserted into the housing 11, the PE-contact pin 12 is held a position such, that the second support section 24 of the PE-contact pin 21 is enclosed by the spring element 43, and the rib 27 is in engagement with the PE-contact pin 21 so as to secure the pin without play. In as much as the spring element 43 as well as the flange 28 and the rib 27 are made of metal a good electrical connection is provided for the ground contact or the PE-contact pin 21 with the housing 11.

Figure 11:
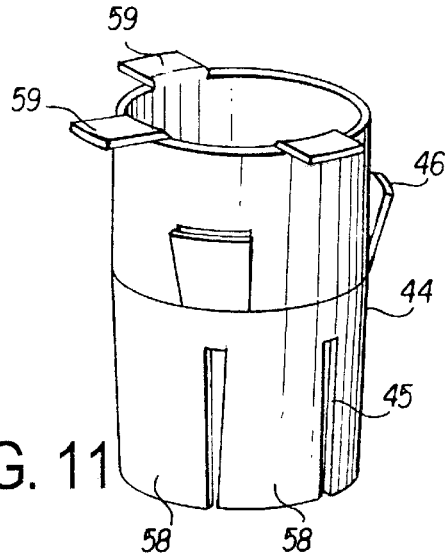
FIG. 11 is a perspective view of a spring element according to a second embodiment of the present invention, which can be used together with the connector part of FIG. 1.

As it is shown in FIG. 11, a spring element is preferably an annular spring element and has a generally cylindrical shape. The spring element of FIG. 11 comprises in the lower area of the cylindrical side wall 44 with a plurality of slots 45 which define spring arms 58 in the cylindrical side wall 44. Generally speaking, the lower area of the spring element 43 has a somewhat smaller diameter than the diameter of the second support section 24 of the contact pin 21. It is thus assured that the spring arms 58 will be slightly bent outwardly when the PE-contact pin 21 enters the spring element 43 so as to allow the movement of the PE-contact pin 21 into the spring element 43 and to provide for a safe electrical contact between the two elements.

Moreover, the spring element of the second embodiment of the present invention comprises in its upper area radially outwardly extending clamping spring arms 46, which will allow a fixation of the spring element 43 in the flange opening 42 of the flange 28. At the upper edge of the spring element of FIG. 11, in addition, radially outwardly extending tabs 59 are provided, which will abut at the upper surface 41 of the flange when the spring element is in its mounted condition.

What is claimed is:

1. A rectangular connector comprising:

a single piece metal housing, having a rearward opening and a forward opening, an insulating body adapted for insertion into said metal housing, through one of said openings of said metal housing, contact elements supported in said insulating body, said insulating body comprising a contact body and a slideable member adapted to be coupled with said contact body, wherein a PE-contact element is adapted to be inserted in a lateral direction into a PE-contact chamber, provided in said insulating body, said PE-contact element being fixedly mounted in said insulating body after insertion of the insulating body into said housing by means of support means provided at said housing, wherein said PE-contact element is securely contacted by contact means provided at said housing, wherein the PE-contact chamber for the lateral insertion comprises a longitudinal slot, wherein said support means comprise a rib which guides the PE-contact element during insertion of the insulating body and secures said PE-contact element in its inserted condition, and wherein the rib extends along a side wall of the housing and projects perpendicularly with respect to said wall into a hollow space defined by the housing and into the longitudinal slot.

2. The connector of claim 1, wherein the contact means comprise a flange which is mounted at the housing preferably at the rib and projects into a hollow space of the housing and into the longitudinal slot.

3. The connector of claim 2, wherein the flange comprises an opening within which a spring element is fixedly mounted.

4. The connector of claim 3, wherein the spring element is an annular spring.

5. The connector of claim 3, wherein the spring element comprises spring arms defined by slots in the upper surface.

6. The connector of claim 3, wherein the spring element comprises clamping arms which clamp the spring element in the mounted condition in said flange.

7. The connector of claim 3, wherein the spring element comprises tabs which prevent that the spring element is completely pushed through said opening in the flange.

8. The connector of claim 1, wherein the insulating body is guided by guide ribs during its insert movement and wherein said guide ribs securely fasten said insulating body in said mounted condition.

9. A rectangular connector comprising:

a single piece metal housing, having a rearward opening and a forward opening, an insulating body adapted for insertion into said metal housing, through one of said openings of said metal housing, contact elements supported in said insulating body, wherein a PE-contact element is adapted to be inserted in a lateral direction into a PE-contact chamber, provided in said insulating body, said PE-contact element being fixedly mounted in said insulating body after insertion of the insulating body into said housing by means of support means provided at said housing, wherein said PE-contact element is securely contacted by contact means provided at said housing, wherein the PE-contact chamber for the lateral insertion comprises a longitudinal slot, wherein said support means comprise a rib which guides the PE-contact element during insertion of the insulating body and secures said PE-contact element in its inserted condition, and wherein the rib extends along a side wall of the housing and projects perpendicularly with respect to said wall into a hollow space defined by the housing and into the longitudinal slot.

* * * * *

UNITED STATES PATENT AND TRADEMARK OFFICE

CERTIFICATE OF CORRECTION

PATENT NO. : 6,739,882 B2 
APPLICATION NO. : 09/795498
DATED : May 25, 2004
INVENTOR(S) : Thomas Christian Führer, Michael Grimm and Jörg Zenkner It is certified that error appears in the above-identified patent and that said Letters Patent is hereby corrected as shown below:

On the title page of the patent, col. 1, under "(75) Inventors:", please correct the spelling of two of the inventor's names, "Fuehrer" to --Führer-- and "Joerg" to --Jörg--.

Col. 2, line 37, after "FIG. 8 is" insert --a--.

Col. 3, line 40, change "and 8 and 9" to --8 and 9--;

line 53, change "housing 1 t" to --housing 11--.

Col. 4, line 17, change "FIG. 7)" to --FIG. 7))--.

line 67, after "section 53" insert a period --.--.

Col. 6, line 2, after "held" insert --in--.

Signed and Sealed this

Twenty-fifth Day of December, 2007

JON W. DUDAS
*Director of the United States Patent and Trademark Office*